US005329340A

United States Patent [19]

Fukuchi et al.

[11] Patent Number: 5,329,340

[45] Date of Patent: Jul. 12, 1994

[54] IMAGE FORMING APPARATUS

[75] Inventors: Yutaka Fukuchi; Kazuhiro Andoh, both of Tokyo, Japan

[73] Assignee: Ricoh Company, Ltd., Tokyo, Japan

[21] Appl. No.: 7,787

[22] Filed: Jan. 22, 1993

[30] Foreign Application Priority Data

Jan. 23, 1992 [JP] Japan ..... 4-031275

[51] Int. Cl.[5] ..... G03G 15/08

[52] U.S. Cl. ..... 355/246; 355/260; 222/DIG. 1

[58] Field of Search ..... 355/246, 260, 245, 298; 222/DIG. 1

[56] References Cited

U.S. PATENT DOCUMENTS

| | | | |
|---|---|---|---|
| 3,678,896 | 7/1972 | Hewitt | 355/298 |
| 3,752,576 | 8/1973 | Gerbasi | 355/298 |
| 4,833,501 | 5/1989 | Büyükgüclü | 222/DIG. 1 |
| 4,945,956 | 8/1990 | Büyükgüclü0 | 222/DIG. 1 |
| 5,036,369 | 7/1991 | Toda et al. | 355/298 |
| 5,040,025 | 8/1991 | Fukuchi | 355/260 |
| 5,045,884 | 9/1991 | Ohira et al. | 355/245 |

*Primary Examiner*—R. L. Moses

*Attorney, Agent, or Firm*—Oblon, Spivak, McClelland, Maier & Neustadt

[57] ABSTRACT

An image forming apparatus having a first toner container storing a toner to be supplied to a developing device, and a second toner container storing a toner to be supplemented to the first toner container. A first and a second sensor are mounted on the wall of the first toner container at a comparatively high level and a comparatively low level, respectively. When the first sensor senses the absence of the toner, the toner is supplemented from the second toner container to the first toner container. When the second sensor senses the absence of the toner, the toner supplementing ability is increased to increase the amount of toner supplement from the second toner container to the first toner container.

16 Claims, 14 Drawing Sheets

IMAGE FORMING APPARATUS

BACKGROUND OF THE INVENTION

The present invention relates to an image forming apparatus having an image carrier and a developing device for developing an electrostatic latent image formed on the image carrier to produce a corresponding toner image.

With an electronic copier, facsimile transceiver, printer or similar image forming apparatus of the type using an image carrier, e.g., a photoconductive element, it is a common practice to electrostatically form a latent image on the image carrier by, for example, exposing it imagewise and then convert the latent image to a toner image by a powdery developer. When a developing device included in the apparatus is implemented with a two component type developer, i.e., a mixture of toner and carrier, it is supplemented with a toner from time to time since it sequentially consumes it. This is also true with a developing device of the type using a one component type developer, i.e., a toner.

It has been customary to provide the apparatus with a toner container storing a toner to be supplemented to the developing device and to supplement, when the amount of toner remaining in the container becomes short or zero, a toner from a toner cartridge or toner bottle to the container, as disclosed in Japanese Patent Application No. 280528/1988. However, this scheme has a problem that the capacity and, therefore, the amount of toner supplement available with a toner cartridge or toner bottle is limited. Specifically, when a great number of images are continuously formed, the operator has to supplement a toner to the toner container frequently, consuming time and labor.

In the light of this, Japanese Patent Laid-Open Publication No. 173683/1990, for example, discloses an image forming apparatus using another or second toner container in addition to the above-mentioned or first toner container. A toner stored in the second container is conveyed to the first container by, for example, a conveyor member and a tubing which guides the toner being transported by the conveyor member. When the amount of toner remaining in the first toner container becomes short or zero, the toner is supplemented from the first container to the second container. Likewise, when the amount of toner remaining in the second container becomes short or zero, a toner is supplemented to the second container. This approach frees the operator from the time- and labor-consuming supplementing work over a long period of time and thereby promotes easy operation of the apparatus. This is especially true when the second container is provided with a great capacity.

However, even the scheme using the first and second toner containers has a problem left unsolved, as follows. When the developing device consumes a particularly great amount of toner, the amount of toner to be supplied from the first toner container to the developing device increases too sharply for the supplement from the second container to the first container to follow. Then, it is likely that the first container runs out of toner despite that the second container is filled with the toner. Although the image forming operation of the apparatus may be interrupted for a moment and then resumed after the supplement of a predetermined amount of toner from the second container to the first container, this would lower the image forming efficiency.

To eliminate the above problem, an arrangement may be made such that the ability to convey the toner from the second container to the first container is enhanced so as to feed, when the absence of toner in the first container is sensed, a great amount of toner from the second container to the first container at a time. This, however, brings about another problem that the great amount of toner is conveyed while suddenly filling up the tubing of the conveying means and, therefore, apt to block up the tubing. Should the conveying means be so constructed as to transport a great amount of toner, the structure would be scaled up to increase the cost. Moreover, when the toner consumption by the developing device decreases after the increase, the amount of toner being supplemented to the first container will become excessive, blocking up the first container.

While the second container provided in addition to the first container reduces the number of times that the operator or serviceman has to supplement a toner, not all of the users need the second container which adds to the cost. Preferably, therefore, the second container should be put on the market as an optional unit, so that a user who does not need it may purchase the image forming apparatus only. In the image forming apparatus without the second container, a toner is supplied to the developing device from the first container only. When the amount of toner remaining in the first container becomes short or zero, the operator supplements a toner to the container from, for example, a toner cartridge.

On the other hand, in the case of the image forming apparatus with the second container, the operator supplements a toner to the second container. The apparatus is so constructed as to allow the operator to supplement a toner contained in, for example, a toner cartridge even to the first container for thereby serving the needs of users who do not want the second container. The operator, therefore, is apt to supplement a toner to the first container by accident. Then, an excessive amount of toner would be filled in the first container to block it up or to exert an excessive load on an agitator disposed in the container for agitating the toner and, in the worst case, damage the agitator. In addition, even when the operator is expected to supplement a toner to the second container, the condition which allows a toner to be supplemented to the first container as well would confuse the operator.

SUMMARY OF THE INVENTION

It is, therefore, an object of the present invention to provide an image forming apparatus which eliminates the problems particular to the conventional apparatus as discussed above.

In accordance with the present invention, an image forming apparatus comprises an image carrier for electrostatically forming a latent image thereon, a developing device for developing the latent image to produce a corresponding toner image, a first toner container storing a toner to be supplied to the developing device, a second toner container storing a toner to be supplemented to the first toner container, a conveying device for conveying the toner from the second toner container to the first toner container, a plurality of sensors each being responsive to a particular amount of the toner remaining in the first toner container, and a drive controller for controllably driving the conveying device to supplement the toner from the second toner container to the first toner container when at least one of the plurality of sensors senses absence of the toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
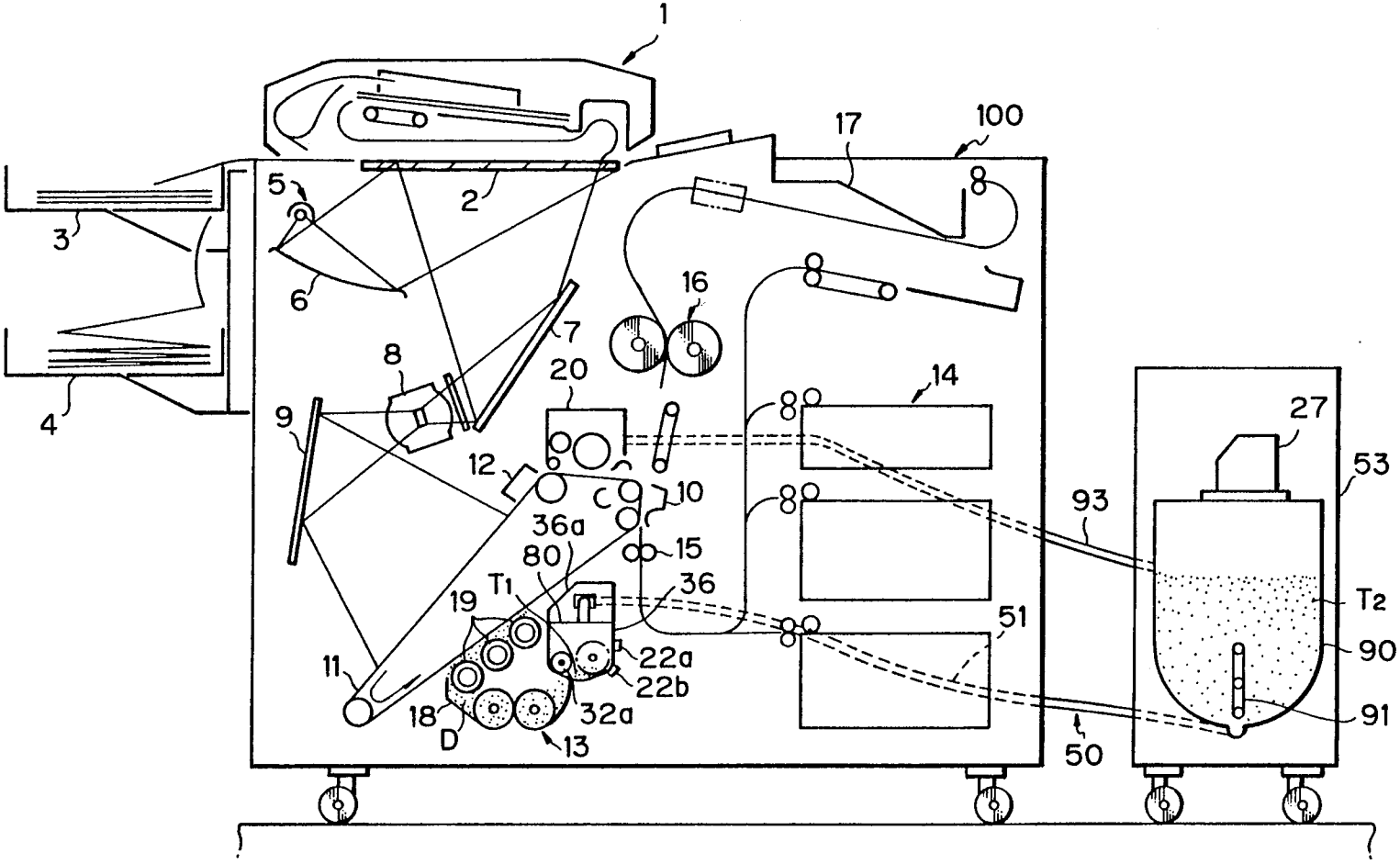
FIG. 1 is a section showing an image forming apparatus embodying the present invention and implemented as a copier.

Referring to FIG. 1 of the drawings, an image forming apparatus embodying the present invention is shown and implemented as an electronic copier by way of example. As shown, the copier is generally made up of a copier body 100, and an ADF (Automatic Document Feeder) 1 mounted on the top of the copier body 100. The ADF 1 feeds a document in the form of a sheet or a computer form toward a glass platen 2 and then returns the document thereto or discharges it to a tray 3 or 4. A light source 5 illuminates the entire document on the glass platen 2 at a time. The resulting reflection from the document is sequentially routed through a mirror 7, a lens 8 and a mirror 9 to be projected onto a photoconductive element implemented as a belt 11. While the belt 11 is driven in a direction indicated by an arrow in the figure, its surface is uniformly charged by a main charger 12. The above-mentioned reflection from the document is projected onto such a charged surface of the belt 11. As a result, a latent image corresponding to the document image is electrostatically formed on the belt 11. A developing device 13 develops the latent image to produce a corresponding toner image. The toner image is transferred from the belt 11 to a recording medium, e.g., a paper fed from a sheet feeing section 14 by a transfer charger 10. The paper carrying the toner image thereon is transported through a fixing device 16 to a tray 17 located in an upper portion of the copier body 100. A cleaning device 20 removes the toner remaining on the surface of the belt 11 after the image transfer.

Figure 3:
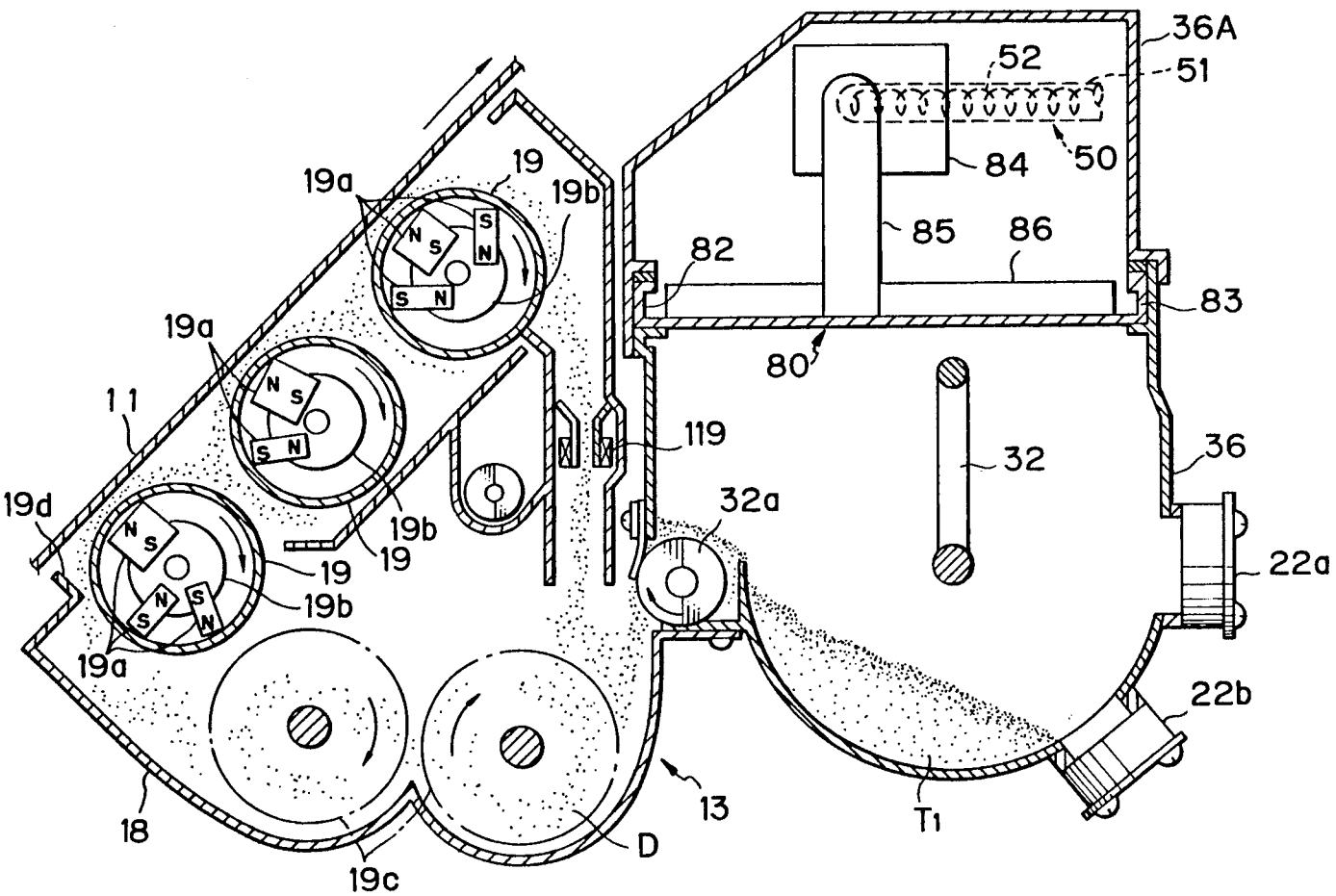
FIG. 3 is a section of a developing device and a first toner container connected thereto.

As best shown in FIG. 3, the developing device 13 has a casing 18 accommodating a suitable number of, three in the embodiment, developing rollers 19 facing the belt 11 and a developer D. The developer D is a powdery two component type developer, i.e., a mixture of toner and carrier. Magnets 19*a* are disposed in each developing roller 19 and mounted on a holder 19*b*. The carrier is magnetic while the developing rollers 19 are nonmagnetic. The developing rollers 19 are each rotated clockwise as viewed in the figure. Paddle wheels 19*c* scoop up the developer D toward the leftmost developing roller 19 while agitating it. Then, the developer D is transported on the surface of the developing roller 19 due to the cooperation of the rotation of the roller 19 and the magnets 19*a*. A doctor blade 19*d* regulates the amount of the developer D to be supplied to the developing roller 19. The developer D is handed over from the leftmost developing roller 19 to the intermediate developing roller 19 and then to the rightmost developing roller 19. Finally, the developer D drops from the rightmost roller 19 to the bottom of the casing 18. While the developer 19 is so transported, the toner contained therein develops the latent image formed on the belt 11 to produce a corresponding toner image.

A toner concentration sensor 119 is located on the path which the developer D moves as stated above. The sensor 119 senses a toner concentration in the developer D.

Figure 5:
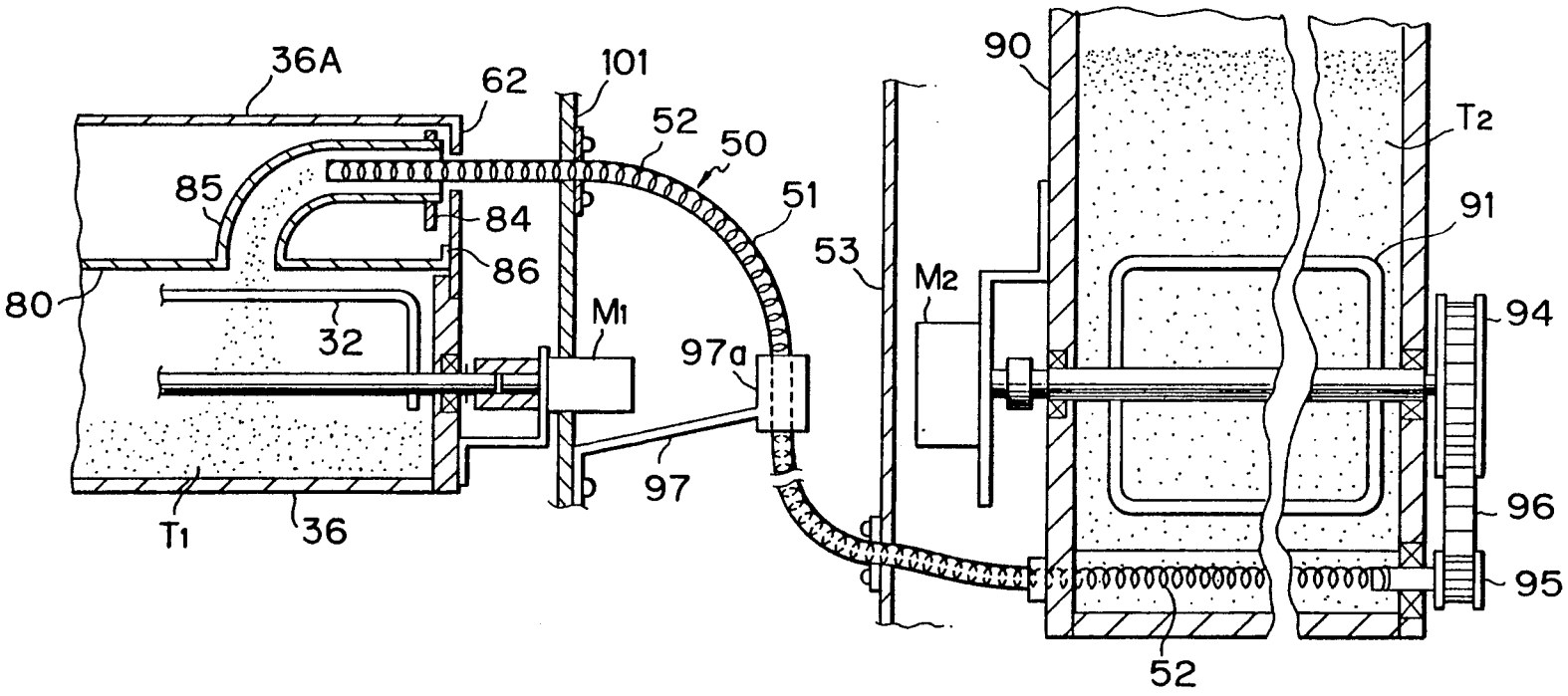
FIG. 5 is a section showing a relation of the first and second toner containers and conveying means with microswitches sand arrangements associated therewith omitted.
Figure 6:
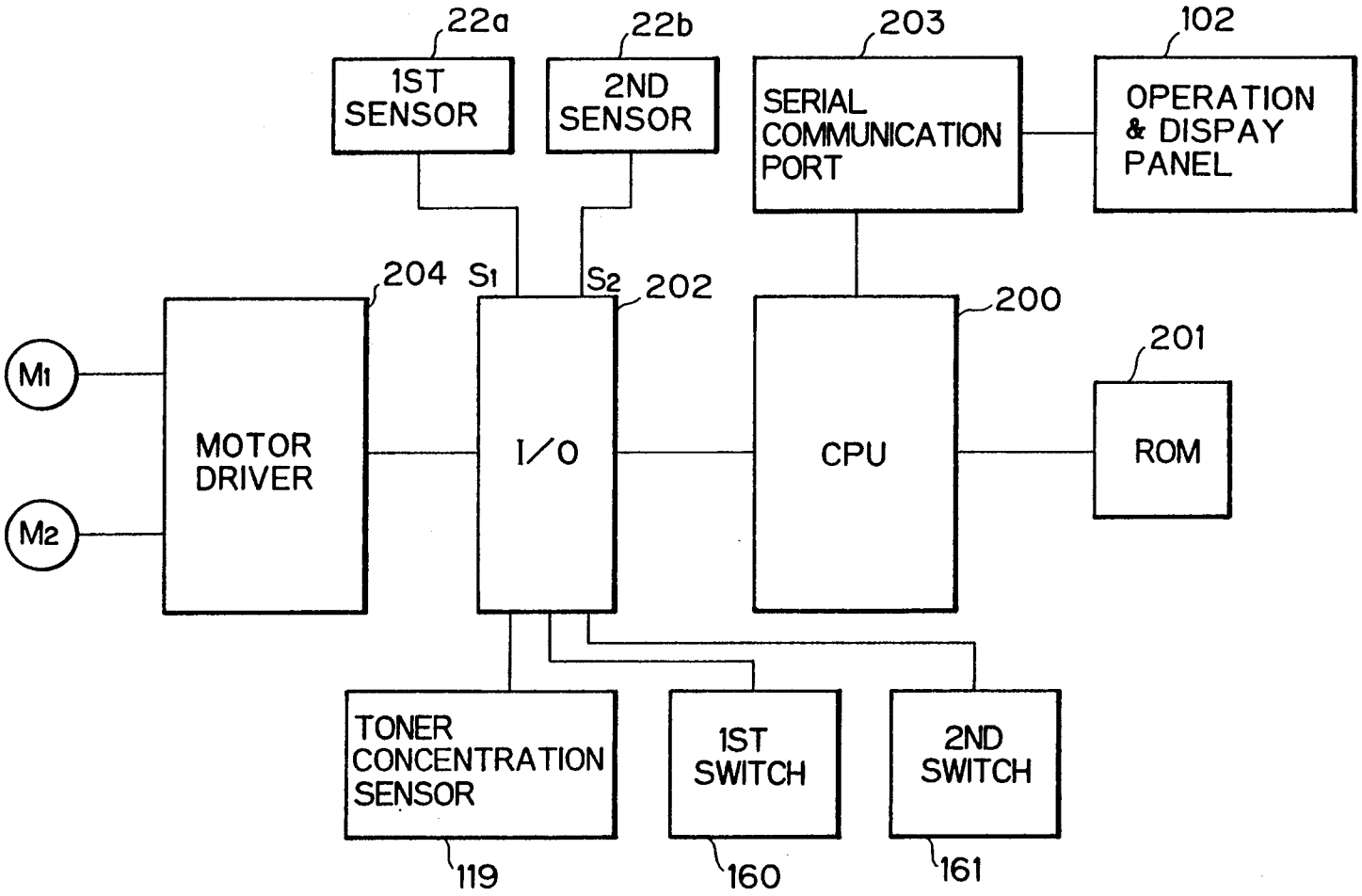
FIG. 6 is a block diagram schematically showing a specific control system included in the embodiment.

As the development is repeated, the toner in the casing 18 is sequentially consumed with the result that the toner concentration of the developer D is sequentially lowered. The decrease in the amount of toner would degrade the quality of the resulting toner image. In the illustrative embodiment, a first toner container 36 is connected to the casing 18 to supplement a fresh toner $T_1$ and is also accommodated in the copier body 100. The toner consists of toner particles and an auxiliary agent added thereto. When the toner concentration of the developer D is lowered as determined by the toner concentration sensor 119, a first motor or toner supply motor $M_1$ shown in FIGS. 5 and 6 is driven for a predetermined period of time. The motor $M_1$ rotates a toner supply roller 32*a* to feed the toner $T_1$ from the toner container 36 to the casing 18, thereby maintaining the toner concentration in the casing 18 in a predetermined range. As shown in FIGS. 3 and 5, a first agitator 32 is disposed in the toner container 36 for agitating the toner $T_1$. When the toner supply roller 32*a* is rotated as stated above, the agitator 32 is also rotated to agitate the toner $T_1$ in the toner container 36.

Figure 2:
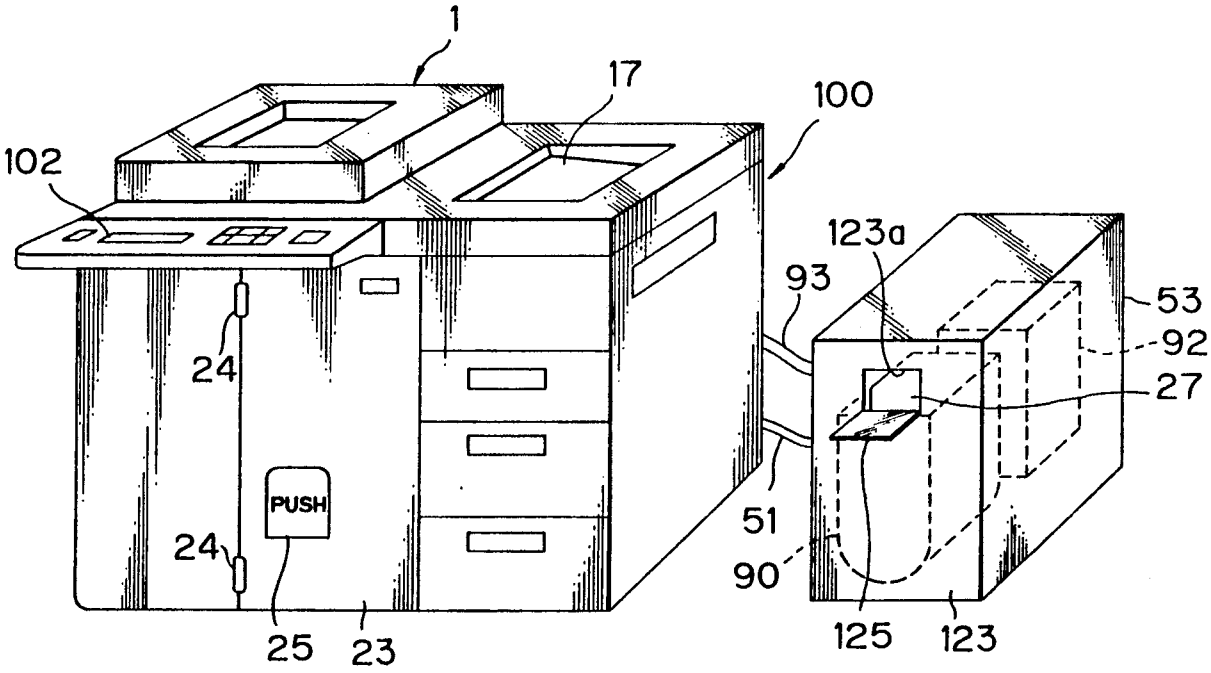
FIG. 2 is a perspective view of the copier shown in FIG. 1.
Figure 4:
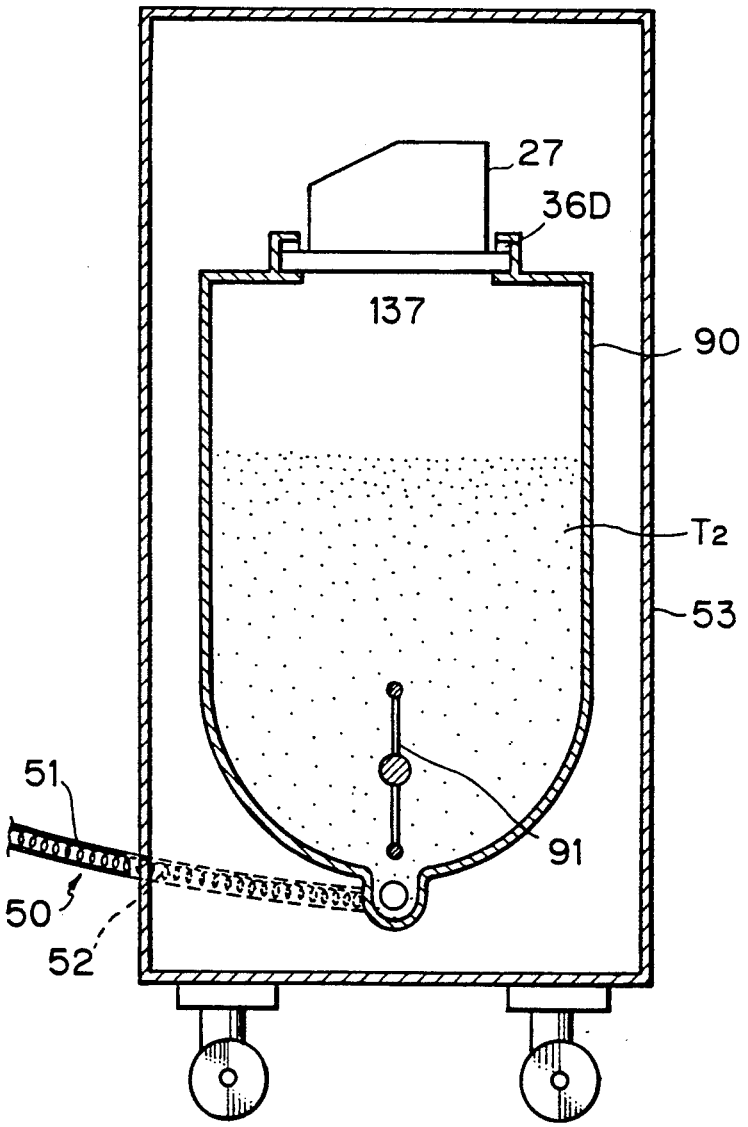
FIG. 4 is a section of a second toner container.

As the supplement of the toner $T_1$ from the toner container 36 to the casing 18 is repeated, the amount of the toner $T_1$ in the toner container 36 sequentially decreases. As shown in FIGS. 1, 2 and 4, a second toner container 90 is provided for supplying a fresh toner $T_2$ to the first toner container 36. The toner containers 90 and 36 are communicated to each other by conveying means 50 which is constituted by a tubing 51 and a conveyor member 52 disposed in and extending throughout the tubing 51. When the amount of toner remaining in the toner container 36 becomes smaller than predetermined one, the conveying means 50 conveys the toner T2 from the container 90 to the container 36, as will be described later specifically.

While the conveyor member 52 is implemented as a coil in the embodiment, the coil may, of course, be replaced with a screw having a spiral blade or a so-called auger. As shown in FIG. 5, one end portion of the conveyor member 52 adjoins the bottom of the toner container 90 and extends a substantial distance in the longitudinal direction.

A second agitator 91 is disposed in the toner container 90 for agitating the toner $T_2$. As shown in FIG. 5, the agitator 91 is journalled to opposite end walls of the container 90. One end of the agitator 91 is connected to a second motor $M_2$ mounted on the associated end wall of the container 90. A timing pulley 94 is mounted on the other end of the agitator 91 while a timing pulley 95 is mounted on the end of the toner conveyor or coil 52. A timing belt 96 is passed over the timing pulleys 94 and 95.

In operation, on the start of rotation of the second motor M2, the agitator 91 starts rotating to agitate the toner $T_2$. The rotation of the agitator 91 is transmitted to the toner conveyor 52 via the timing pulley 94, timing belt 96 and timing pulley 95, thereby rotating the toner conveyor 52. As a result, the toner $T_2$ is transported from the container 90 to the container 36 while being guided by the tubing 51 and a guide pipe 85 which will be described.

As shown in FIGS. 1, 2 and 4, the container 90 is accommodated in a toner supplement casing 53 which is physically separate from the copier body 100. The tubing 51 connected to the container 90 extends out from the casing 53, enters the copier body 100 from the rear, and protrudes into the guide pipe 85 through a rear frame 101 included in the copier body 100, as shown in FIG. 5. Such a configuration allows the toner from the container 90 to enter the container 36 via the guide pipe 85. The tubing 51 is made of soft resin, rubber or similar elastic material, so that the casing 53 may be moved independently of the copier body 100.

As shown in FIGS. 1 and 4, a toner cartridge 27 is removably attached to the top wall of the container 90 to close an opening 137 formed through the top wall. In this sense, the cartridge 27 plays the role of a lid. A seal member 36D surrounds the toner cartridge 27 to prevent the toner $T_2$ in the container 90 from being scattered around via the opening 137.

When the amount of toner remaining in the container 90 becomes short or practically zero, a lid 125, FIG. 2 hinged to the casing 53 is opened by hand to the position shown in FIG. 2. The used toner cartridge 27 is pulled out through an opening 123*a* uncovered then. Subsequently, a new toner cartridge is inserted into the casing 53 via the opening 123*a* and then set on the opening 137 of the container 90 to supplement a toner to the container 90. If a single toner cartridge 27 cannot fill up the container 90, two or more toner cartridges will be used one after another. The configuration of the cartridge 27 will be described later. If desired, the front wall of the casing 53 may be implemented as an openable door cover 123 so as to accommodate a toner vessel far greater than an ordinary toner cartridge or toner bottle. However, the toner cartridge 27 is advantageous over such a large vessel since it is easier to carry and set.

As shown in FIG. 2, a bottle or similar receptacle 92 is also disposed in the casing 53 for collecting the waste toner removed by the cleaning device 20, FIG. 1. Specifically, the waste toner is conveyed from the cleaning device 20 to the receptacle 92 by a flexible tubing 93 and a conveyor member, not shown, disposed in the tubing 93 and constituted by, for example, a coil. Alternatively, the waste toner from the cleaning device 20 may be conveyed to the toner cartridge 27 mounted on the toner container 90 and emptied.

The container 90 has a greater capacity than the container 36, e.g., the former is six to seven times as great as the latter. By disposing the container 90 in the casing 53 independent of the copier body 100, it is possible to provide the container 90 with any desired capacity; otherwise, the capacity would be limited by the narrow space available in the copier body 100. Specifically, it has been customary to fix a second toner container on the side of a developing device within a copier body or on the outer surface of the copier body. This prevents the capacity of the second toner container from being increased due to the size of the copier body which is decreasing.

As stated above, the second container 90 has a great capacity and, therefore, can accommodate a great amount of toner $T_2$. This makes it needles for the operator or serviceman to frequently supplement the toner $T_2$ to the container 90, promoting easy handling.

The toner $T_2$ in the container 90 is fed to the container 36 when the toner $T_1$ in the container 36 becomes short. At this instant, in a conventional image forming apparatus of the type concerned, when a particularly great amount of toner is consumed by a developing device, the amount of toner to be transferred from a first toner container to the developing device sharply increases. Then, it is likely that the supplement of toner from a second toner container to the first toner container cannot follow the consumption, as discussed earlier. Should the ability to convey the toner from the first container to the second container be increased, the toner might block up a tubing or might be fed to the first container in an excessive amount to also block it up.

To eliminate the above problem, as shown in FIG. 3, a plurality of, two in the embodiment, toner sensors 22*a* and 22*b* are mounted on the toner container 36. The toner sensors 22*a* and 22*b* are each responsive to a particular amount of toner remaining in the container 36. In the specific arrangement shown in FIG. 3, the toner sensor 22*b* is located in the vicinity of the bottom of the container 36 while the toner sensor 22*a* is disposed at a higher level than the toner sensor 22*b*. The toner sensors 22*a* and 22*b* are arranged one above the other substantially in the perpendicular direction. Hence, as the toner $T_1$ in the toner container 36 sequentially decreases, the toner sensor 22*a* senses the absence of toner. As the toner $T_1$ further decreases, the toner sensor 22*b* senses the absence of toner. In the illustrative embodiment, these sensors 22*a* and 22*b* are each implemented as a piezoelectric sensor whose oscillation frequency changes with a change in the amount of toner facing it. The piezoelectric sensors may be replaced with light transmission type sensors, if desired.

When at least one of the toner sensors 22*a* and 22*b*, 22*a* in the embodiment, senses the absence of toner, the previously mentioned motor $M_2$ is energized to rotate the conveyor member 52. As a result, the toner $T_2$ is fed from the container 90 to the container 36 via the tubing 51. After the supplement has been continued for a predetermined period of time or when the sensor 22a senses the toner, the motor $M_2$ is deenergized.

In the above construction, the toner $T_2$ is fed from the container 90 to the container 36 when the sensor 22a senses the absence of toner, i.e., when a substantial amount of toner still remains in the container 36. Therefore, even when the toner consumption by the developing device 13 and, therefore, the toner supply from the container 36 to the device 13 sharply increases, the supplement from the container 90 to the container 36 sufficiently follows it. This allows the image forming operation to be continued at high speed without interruption and thereby allows a great number of images to be formed stably over a long period of time. In addition, since the supplement to the container 36 occurs before the container 36 runs out of the toner $T_1$, the frequency of supplement is increased and, therefore, the amount of the toner $T_2$ which should be fed from the container 90 at a time is reduced. More specifically, it is not necessary to feed the toner $T_2$ in a great amount to the tubing 51, preventing the toner $T_1$ from stopping the tubing 51. At the same time, the tone $T_2$ is prevented from being supplemented in an excessive amount to the container 36 and, therefore, from blocking it.

Further, in the embodiment, the ability of the conveying means 50 is increased as the toner sensors 22a and 22b sequentially sense the absence of toner. Specifically, when the sensor 22a senses the absence of toner, the conveyor member 52 starts rotating. As the sensor 22b senses the absence of toner, the rotation speed of the conveyor member 52 is increased to transport a greater amount of toner to the container 36. This is because the absence of toner sensed by the toner sensor 22b means that the amount of toner remaining in the container 36 is little or practically zero due to, for example, the sharp increase in the toner consumption by the developing device 13. This is also true when three or more toner sensors are mounted on the toner container 36 at successive levels. In any case, the toner in the container 36 is surely prevented from becoming short or from being supplemented in an excessive amount.

Referring to FIG. 6, a control system for executing the above control will be described. As shown, the system has a CPU (Central Processing Unit) 200 for controlling the entire copier, a ROM (Read Only Memory) 201 storing a control program, an I/O (Input/Output) 202 for interfacing various electrical constituents to the CPU 200, an operation and display panel 102 (see FIG. 2 also) for entering a copying operation and interfacing the copier to the operator, and a serial communication port 203 interconnecting the panel 102 and CPU 200. The toner concentration sensor 119 and toner sensors 22a and 22b are connected to the CPU 200 via the I/O 202. A motor driver 204 is connected to the output port of the I/O for driving the motors $M_1$ and $M_2$.

As the toner concentration of the developer D in the developing device 13 decreases as determined by the toner concentration sensor 119, the resulting output of the sensor 119 is applied to the CPU 200 via the I/O 200. In response, the CPU 200 causes the motor driver 204 to drive the motor $M_1$ with the result that the agitator 32, FIG. 5, is rotated. At the same time, the toner supply roller 32a, FIG. 3, connected to the motor $M_1$ is rotated to feed the toner $T_1$ from the toner container 36 to the casing 18. On the other hand, the outputs, i.e., signals $S_1$ and $S_2$ from the sensors 22a and 22b mounted on the container 36 are also applied to the CPU 200 via the I/O 202.

Figure 7:
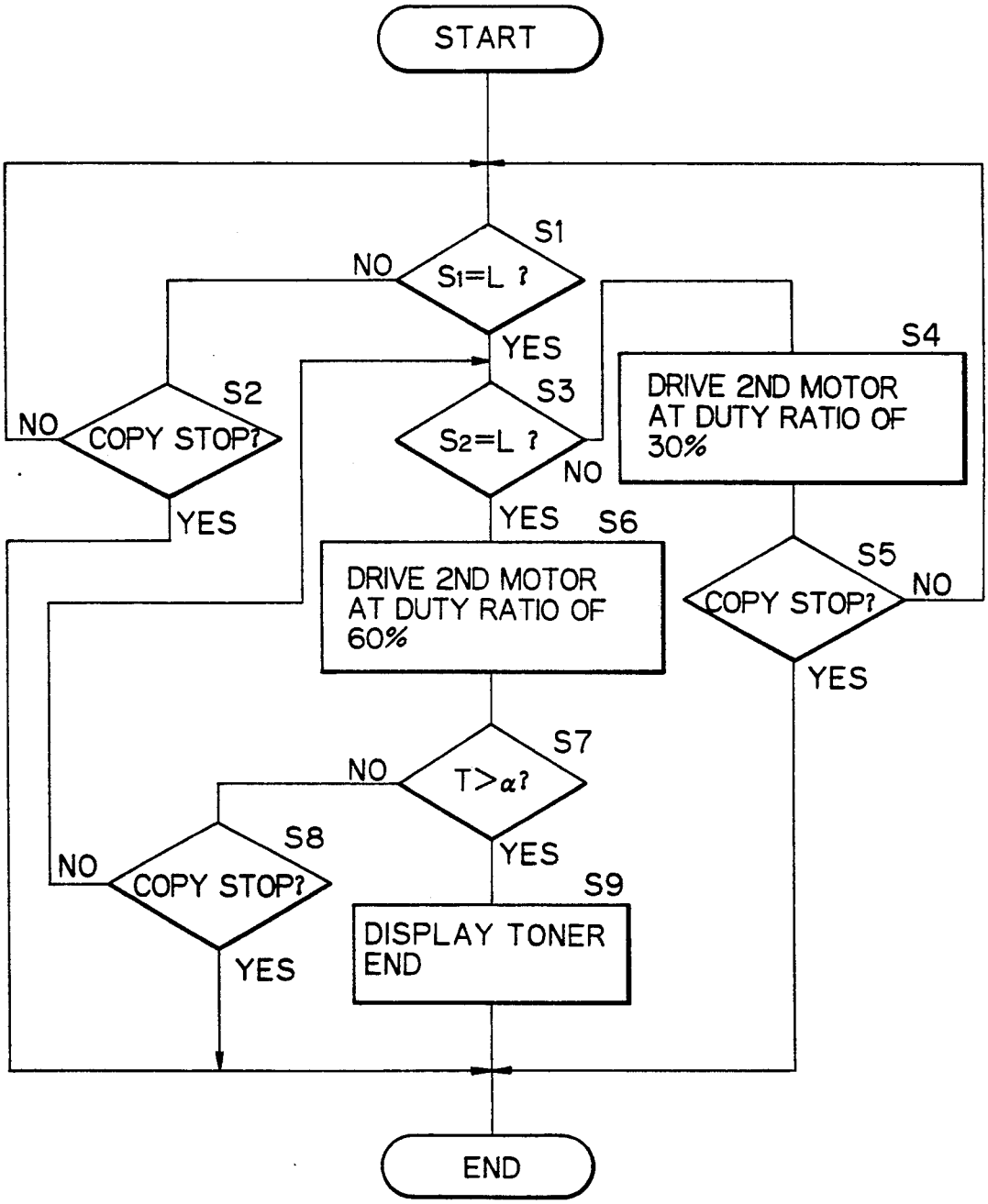
FIG. 7 is a flowchart demonstrating a specific toner supplement procedure to be executed by the control system.

FIG. 7 shows a specific operation of the control system, particularly the control over the supplement of toner from the container 90 to the container 36. In the figure, "L" associated with the signals $S_1$ and $S_2$ indicates that the sensor 22a or 22b has sensed the absence of toner. On receiving a copy start signal from the operation and display panel 102, the CPU 200 starts on the control according to the program stored in the ROM 201.

Figure 8A:
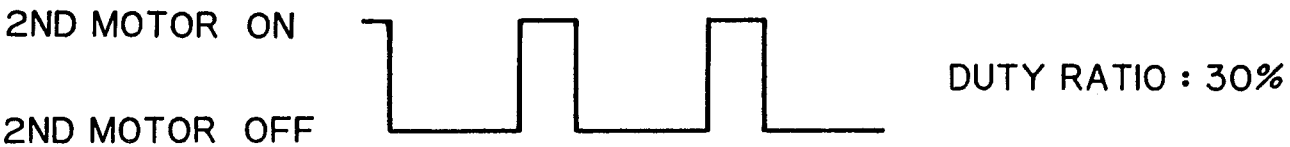
FIGS. 8A and 8B are timing charts representative of the operation of a second drive motor.
Figure 9:
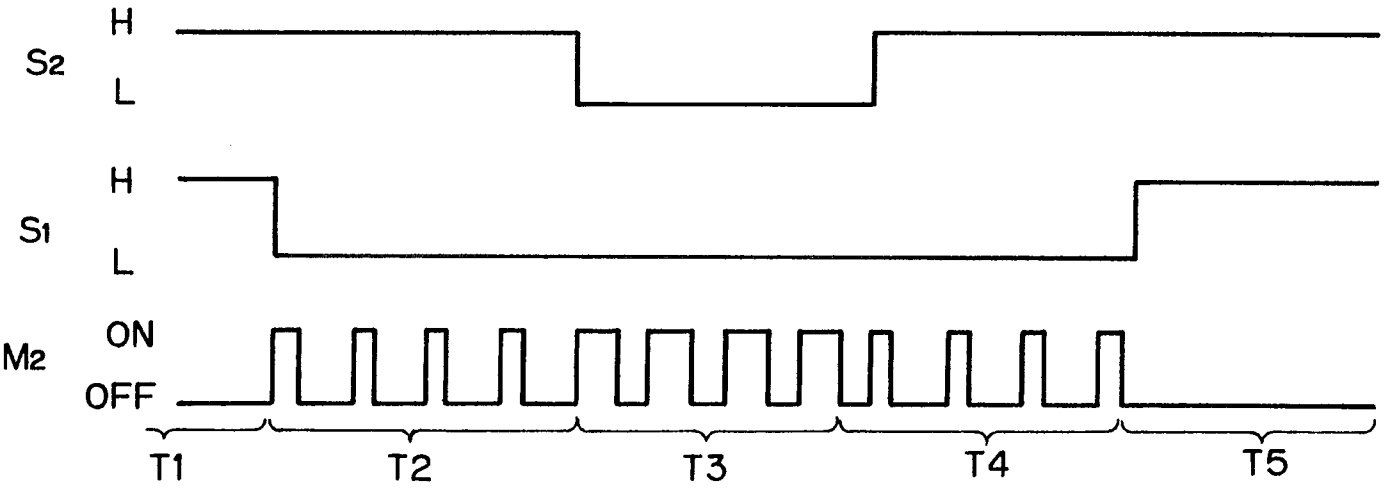
FIG. 9 is a timing chart representative of the operations of a first and a second sensor and the second drive motor.

First, the CPU 200 determines whether or not the output signal $S_1$ of the sensor 22a is L (step S1). If the answer of the step S1 is No, meaning that the sensor 22a has not sensed the absence of toner yet, the CPU 200 maintains the motor $M_2$ deenergized determining that a great amount of toner exists in the container 36. The CPU 200 continuously senses the signal $S_1$ until a copy stop signal arrives or until the copying operation entered on the operation and display panel 102 ends (S2). In FIG. 9, this is represented by a period of time $T_1$. In FIG. 9, "H" indicates that the sensor 22a or 22b shows that the toner is still present. When the signal $S_1$ becomes L while the copying operation is under way, i.e., when the sensor 22a senses the absence of toner, the CPU 200 determines whether or not the output signal $S_2$ of the sensor 22b is L. If the signal $S_2$ is not L, meaning that the sensor 22b has not sensed the absence of toner yet, the CPU 200 turns on the motor $M_2$ (S4). At this time, as shown in FIG. 8A, the motor $M_2$ is driven at a duty ratio of 30 percent, i.e., repetitively turned on by 30 percent and turned off by 70 percent. This part of the procedure is represented by $T_2$ in FIG. 9. As a result, the motor $M_2$ is rotated at a comparatively low speed to rotate the conveyor means 52 of the conveying means 50 at a corresponding speed. Therefore, the toner $T_2$ is fed from the container 90 to the container 36. Such a loop is repeated so long as the copying operation is continued, i.e., the control ends when a copy stop signal arrives (S5). When the signal $S_1$ goes high (H) due to the supplement of the toner $T_2$ to the container 36, the motor $M_2$ is turned off to end the supplement.

Figure 8B:
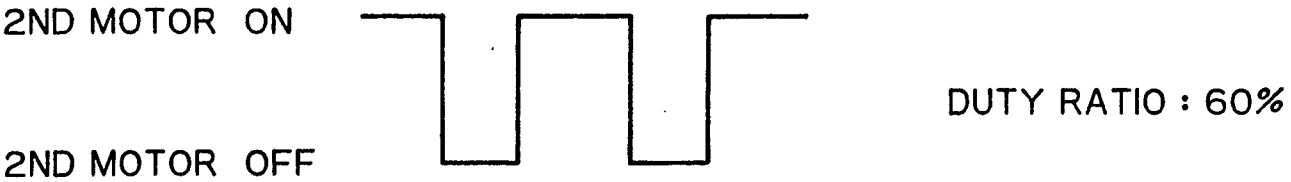

Assume that the amount of toner remaining in the container 36 decreases to such a level where the signal $S_2$ becomes L (S3). Then, the CPU 200 causes the motor $M_2$ to rotate at a duty ratio of 60 percent (S6), as shown in FIG. 8B. Specifically, the rotation speed of the motor $M_2$ is increased to enhance the ability of the conveying means 50. This is represented by $T_3$ in FIG. 9. Consequently, a great amount of supplementary toner is fed to the container 36.

The CPU 200 counts the period of time T during which the signal $S_2$ remains in a low level (L). Until the period of time T exceeds predetermined one $\alpha$, the toner supplement is continued so far as the copying operation is not stopped. As soon as the signal $S_2$ goes high (H) due to the increase in the amount of toner in the container 36, the CPU 200 changes the duty ratio of the motor $M_2$ from 60 percent to 30 percent to thereby reduce the rotation speed. Further, when the signal $S_1$ goes high, the CPU 200 stops the rotation of the motor $M_2$ (S3, S4 and S1). This part of the procedure is represented by $T_4$ and $T_5$ in FIG. 9. As the period of time T exceeds $\alpha$ (S7), the CPU 200 determines that the container 90 has also run out of toner. Then, the CPU 200 displays a toner end message on the operation and display panel 102 (S9) while stopping the copying operation. The toner end message urges the operator to supplement a toner to the container 90.

Preferably, a toner near end message should be produced on the operation and display panel 102 at an adequate time before the toner end message, reporting the operator that the toner in the container 90 will soon end. For example, when $S_2$ is L in the step S3, "SUPPLEMENT TONER" or similar toner near end message is displayed. As the copying operation is continued without toner supplement until the period of time T expires $\alpha$, the toner end message is displayed.

It will be seen from the above that the CPU 200, ROM 201, I/O 202 and motor $M_2$ constitute drive control means for controlling the conveying means 50. When at least one of a plurality of sensors each being responsive to a particular remaining amount of toner senses the absence of toner, the drive control means drives the conveying means 50 to supplement the toner from the second toner container to the first toner container. As the sensors sequentially senses the absence of toner, the drive control means sequentially increases the ability of the conveying means 50.

It is preferable to construct the container 90 into an optional unit which only the users needing it can purchase. Specifically, the copier body 100 will be accompanied by the toner container 90 and casing 53 for users needing the container 90 or will not be accompanied by them for the other users. In such a case, to allow a user purchased the copier without the container 90 to supplement a toner to the container 36, the copier is provided with the following arrangement in addition to or in place of part of the above-described arrangement.

Figure 10:
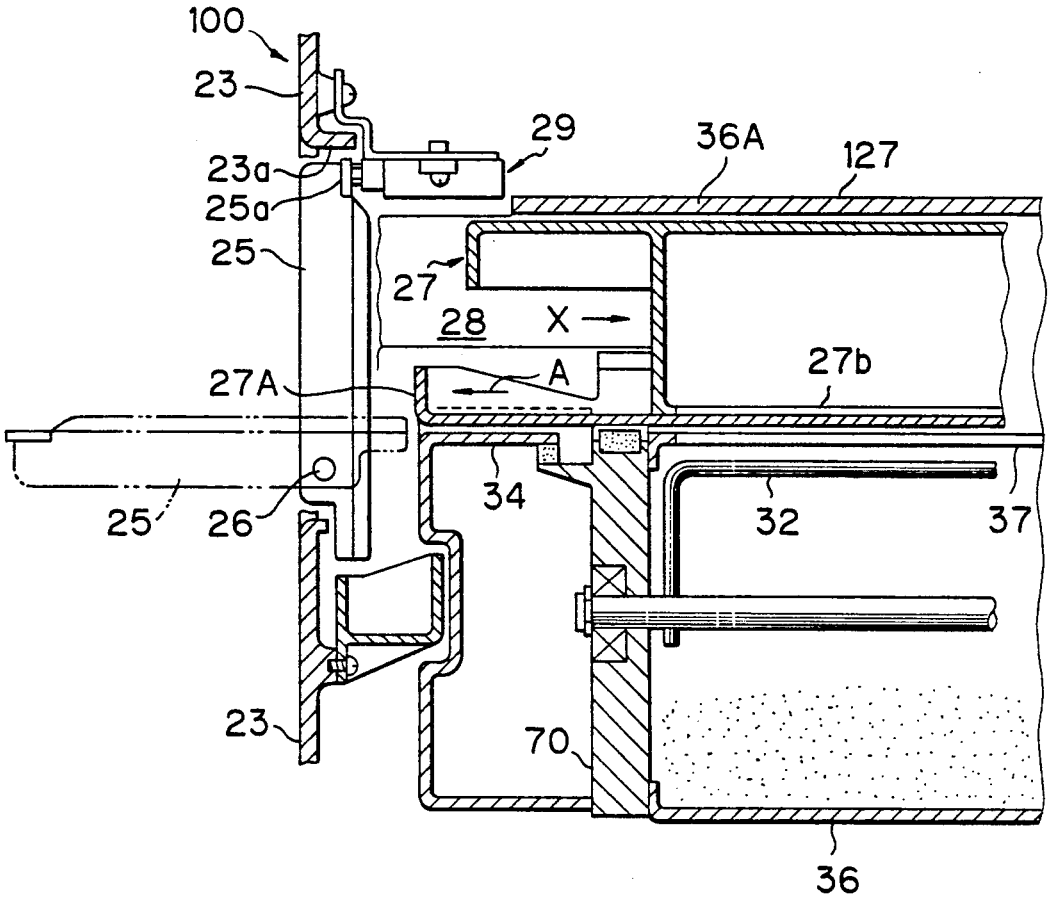
FIG. 10 is a section of a toner cartridge located above the first toner container with the microswitches and arrangements associated therewith omitted.

As shown in FIG. 2, a door cover 23 forms part of the housing of the copier body 100 and is openable about hinges 24. A lid 25 is openably attached to the door cover 23. The door cover 23 may be opened to, for example, remove a jamming sheet. A lug is provided on the inner surface of the door cover 23 while an interlock switch is mounted on the copier body 100 to cooperate with the lug, although not shown in FIG. 2. When the door cover 23 is opened, the interlock switch is turned off to interrupt the copying operation for safety purpose. When the door cover 23 is closed, the interlock switch is turned on to resume the copying operation. As shown in FIG. 10, the lid 25 is hinged to the door cover 23 by a shaft 26.

Figure 11:
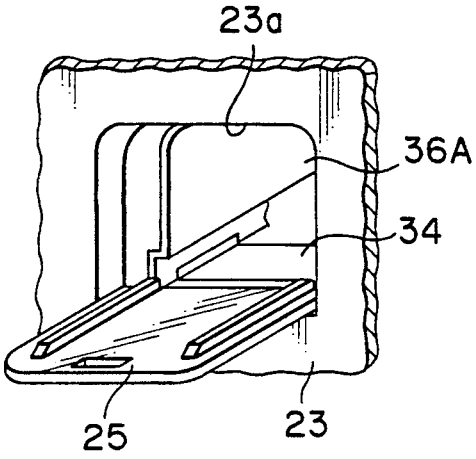
FIG. 11 is a perspective view of a lid attached to a door cover of a copier body and held in an open position.

As shown in FIG. 11, an opening 23*a* is formed through the door cover 23 for the insertion and removal of the toner cartridge 27. As shown in FIG. 10, a passageway 28 for the cartridge 27 is provided above the toner cartridge 36 and contiguous with the opening 23*a*. The lid 25 selectively opens or closes the opening 23*a*. As also shown in FIG. 10, a magnetic piece 25*a* is affixed to the end of the lid 25 while a so-called push-push type magnet catch 29 is affixed to the copier body 100 for attracting the magnetic piece 25*a*. For example, when the lid 25 is pressed once, it is opened; when it is pressed again, it is closed.

Assume that the toner container 90 is not used, i.e., it is not purchased together with the copier body 100. Then, as shown in FIG. 10, a toner cartridge 27 having exactly the same configuration as the cartridge 27, FIG. 4, set on the toner container 90 is inserted into the copier body 100 as far as an opening 37 formed through the top of the toner container 36.

Figure 12:
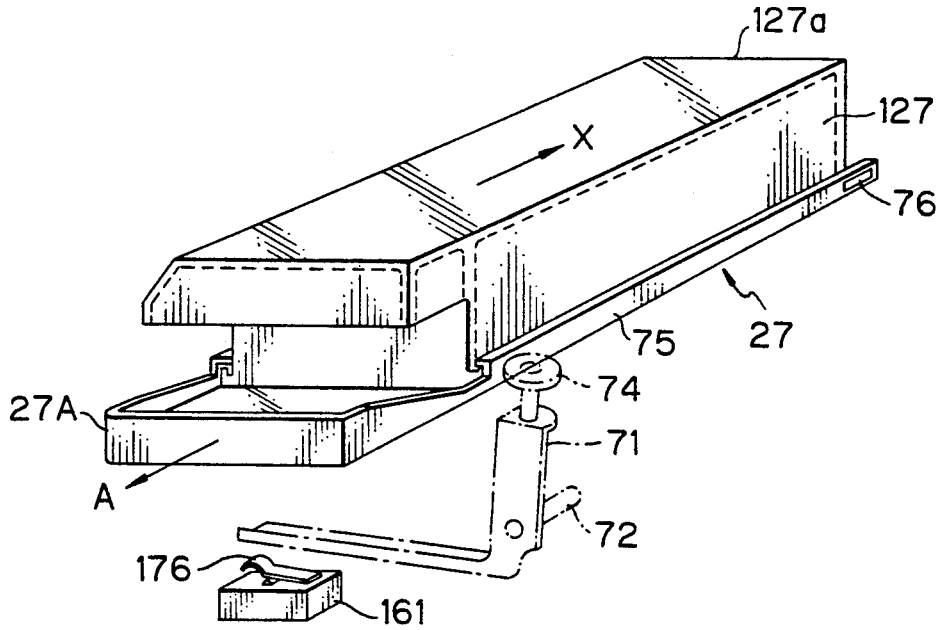
FIG. 12 is a perspective view of the toner cartridge.

FIG. 12 shows the configuration of the toner cartridge 27. As shown, the cartridge 27 has a body 127 and a shutter 127A openably closing an opening 27*b* (see FIG. 10) formed through the bottom of the body 127. The cartridge 27 is filled with a fresh toner. The shutter 27A is implemented as a slide lid slidable relative to the body 127 in a direction indicated by an arrow A in the figure. When the shutter 27A is pulled outward in the direction A, it uncovers the opening 27*b* of the body 127.

When the toner container 90 is not used, the sensor 22*a* provided on the toner container 36 is not used. Specifically, when the sensor 22*b* senses the absence of toner, the toner near end message appears on the operation and display panel 102 to urge the operator to supplement a toner. When no toner is supplemented to the toner container 36 despite the toner near end message, the toner end message appears on the panel 102 as soon as a predetermined number of copies are produced. At the same time, the copying operation under way is stopped.

Usually, the operator or serviceman alerted by the toner near end message presses the lid 25 once to move it from an upright or closed position (solid line) to a horizontal or open position (phantom line). Then, the operator pulls out the used cartridge 27 from the passageway 28 in the direction A, i.e., toward the operator. This does not require the image forming operation to be interrupted. Specifically, since the lid 25 is not provided with the interlock device described in relation to the door cover 23, the image forming operation is not interrupted even when the lid 25 is opened.

After the removal of the used cartridge 27, the operator inserts a new cartridge 27 into the copier body 100 via the opening 23*a* in a direction opposite to the direction A while using the lid 25 and an inner cover 34 affixed to the toner container 36 as a guide. As a result, the cartridge 27 advances the passageway 28 defined by a cartridge cover 36A which is constructed integrally with the toner container 36, until it has been set on the toner container 36. Of course, the operator may open the door cover 23 to mount or dismount the cartridge 27. In such a case, the cartridge 27 will be directly put on the inner cover 34.

After the operator has fully inserted the new cartridge 27 to the position shown in FIG. 10, the operator pulls only the shutter 27A in the direction A until the shutter abuts against a stop, not shown, provided on the body 127. At this time, the opening 27*b* in the bottom of the body 127 is uncovered. Consequently, a fresh toner is let fall from the cartridge 27 into the toner container 36 via the top opening 37 of the container 36. Thereafter, the operator pushes the shutter 27 to the original position and then closes the lid 25.

It is to be noted that the above-described arrangement associated with the lid 25 and the arrangement for guiding the cartridge 27 are similarly applicable to the lid 125 of the casing 53 and a passageway defined in the casing 53. Specifically, the operator may pull out the used cartridge 27 from the casing 53 via the opening 123*a*, insert a new cartridge 27 via the opening 123*a*, and then pull the shutter 27A to supplement a fresh toner to the toner container 90 via the top opening 137, FIG. 4.

When the toner container 90 is absent, the casing 53 is also absent. In such a case, the waste toner from the cleaning device 20 may be collected in an exclusive receptacle mounted on the copier body 100 or in the toner cartridge 27 set on the toner container 36 and emptied. The latter implementation is disclosed in Japanese Patent Application No. 280528/1988.

As stated above, a toner may be supplemented to the toner container 90 or to the toner container 36, as needed. However, the problem is that when the toner container 90 is present, the toner cartridge 27 can be inserted not only into the casing 53 via the opening but also into the copier body 100 via the opening 23*a*. Specifically while a person is expected to insert the cartridge 27 into the casing 53 via the opening 123*a* so long as the container 90 is present, the person may accidently insert it into the copier body 100 via the opening 23*a* to supplement the toner into the container 36. Then, an excessive amount of toner will be supplied to the container 36 to block it up or exert an excessive load on the agitator 32.

To eliminate the accidental operation described above, the user who does not need the container 90 may be supplied with a copier body whose door cover 23 is not provided with the lid 23. However, this is undesirable from the cost standpoint since the copier body 100 with the container 90 and the copier body 100 without it have to be provided with far different configurations.

Figure 13:
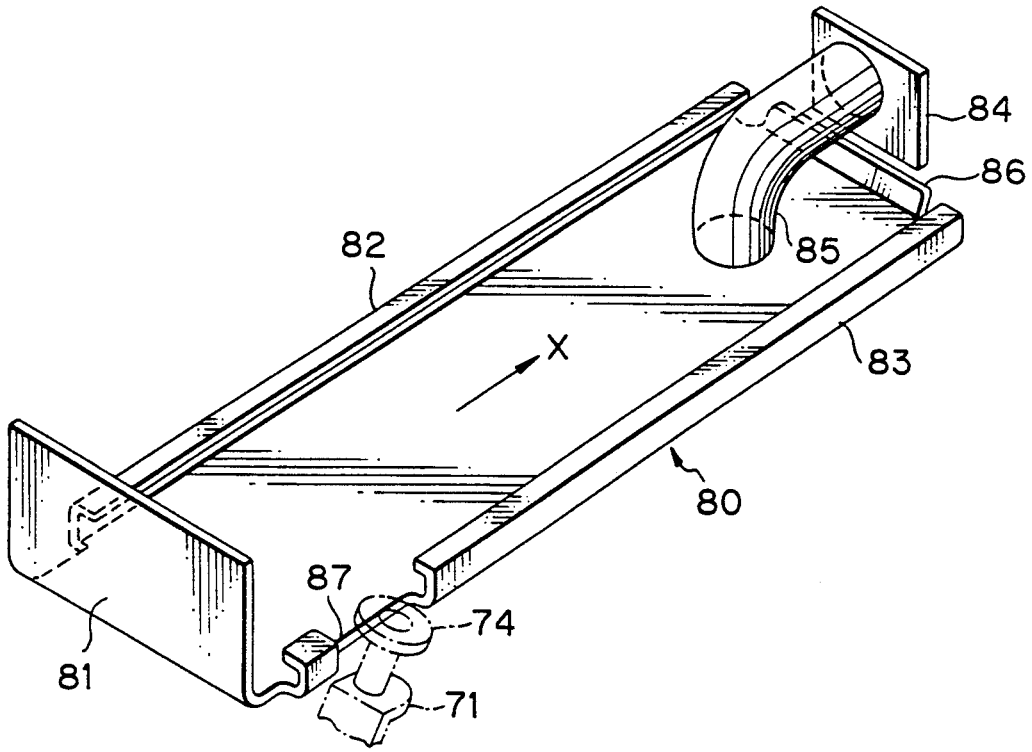
FIG. 13 is a perspective view of a restriction member.

In the light of the above, as shown in FIGS. 3 and 5, a restriction member 80 is used when the copier is provided with the container 90. Specifically, the restriction member 80 is set above the container 36 to prevent a person from supplementing a toner to the container 36. As shown in FIG. 13, the restriction member 80 has a bottom provided with the same dimensions as the shutter 27A of the cartridge 27, and opposite sides 82 and 83 having the same configuration as the side 75, FIG. 12, of the shutter 27A. A stop 86 protrudes from the innermost end of the restriction member 80 while an obstruction plate 81 protrudes from the outermost end of the member 80. The guide pipe 85 stated earlier is affixed to the bottom of the innermost portion of the restriction member 80. A plate 84 is affixed to the end of the guide pipe 85.

As shown in FIG. 10 when the container 90 is not used, the cartridge 27 is set on the container 36. On the other hand, when the container 90 is used, the restriction member 80 is inserted in the passageway 28 via the opening 23*a* in place of and in exactly the same manner as the cartridge 27. FIG. 5 shows the restriction member 80 in a predetermined set position. Thereafter, the lid 25 is closed. At this instant, the stop 86 of the restriction member 80 abuts against the innermost end 62 of the cartridge cover 36A to thereby position the member 80. The end of the tubing 51 enters the guide pipe 85. In this condition, the toner from the container 90 can be transferred to the container 36 while being guided by the guide pipe 85.

When the restriction member 80 with the guide pipe 85 is used as stated above, it is not necessary to provide the container 36 with extra toner guide means. When the containers 36 and 90 are connected together by the conveying means 50, all that is required is to insert the restriction member 80 into the space above the container 36.

In the set position of the restriction plate 80, the obstruction plate 81 closes the opening 23*a* of the lid 25 at the inside of the opening 23*a*. Preferably, a locking device, not shown, should be provided for preventing the restriction plate 80 from being pulled out from the set position. Advantageously, a message, e.g., "DO NOT INSERT CARTRIDGE" may be provided on the outer surface of the obstruction plate 81. When a person accidentally opens the lid 25 to replace the cartridge 27, the restriction plate 80 appears and successfully prevents the person from replacing it. The locking device and/or the message on the obstruction plate 81 will further enhance the restriction. Moreover, the obstruction plate 81 closes the opening 23*a* and, therefore, makes the lid 25 omissible. At the same time, the restriction member 80 closes the top opening 37 of the container 36 and, therefore, prevents the toner from being scattered around to the outside.

The restriction member 80 or the cartridge 27 is set in the container 36, depending on whether or not the container 90 is used, as stated above. Sensing means may advantageously be provided for informing the operator of the fact that the restriction member 80 is mounted on the container 36. Then, in response to the output of the sensing means, there will be displayed on, for example, the operation and display panel 102 a message indicating the presence of the restriction plate 80, i.e., inhibiting the operator from supplementing a toner to the container 36. A specific form of such sensing means will be described hereinafter.

Figure 14:
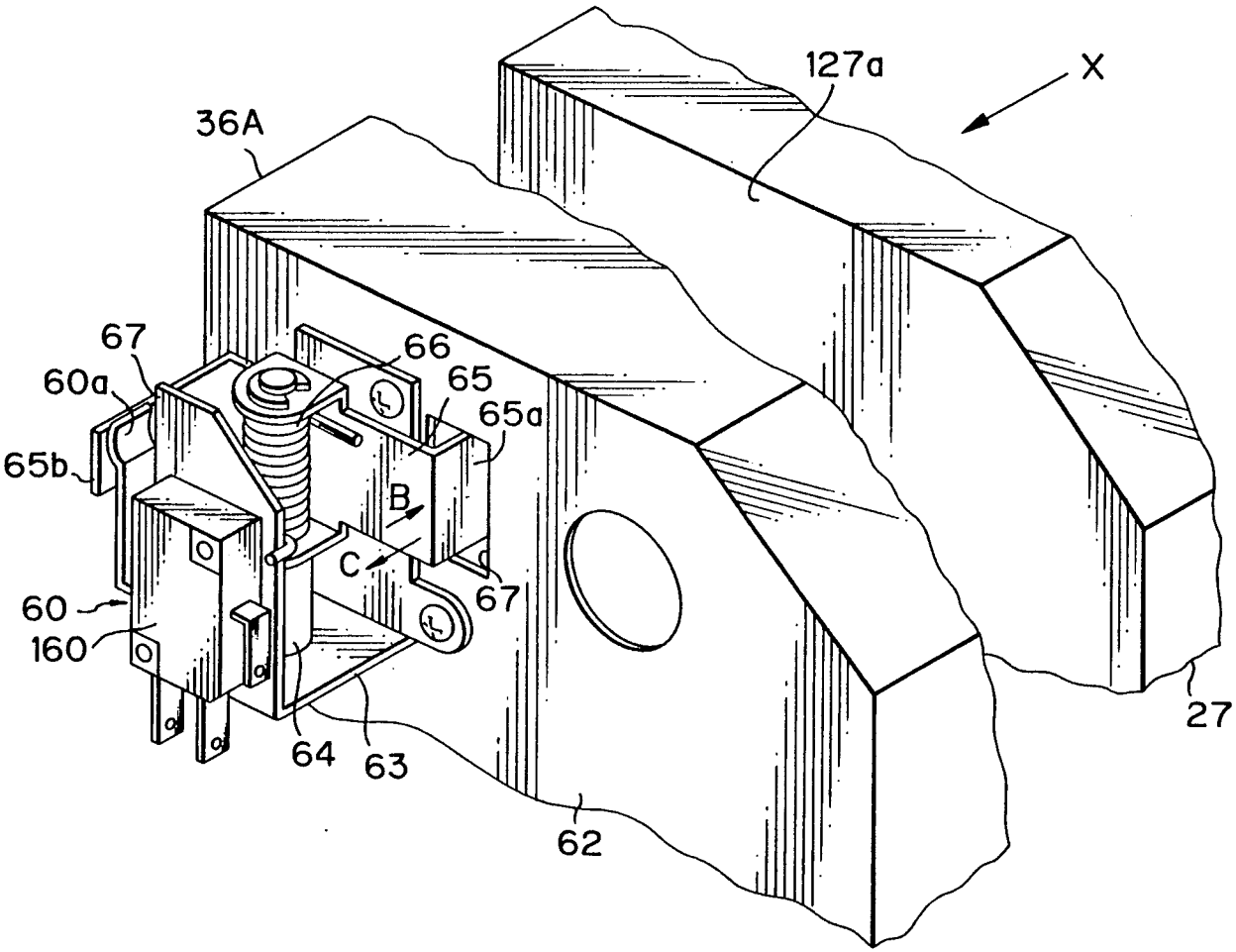
FIG. 14 is a perspective view of the microswitch mounted on an inner portion of the cartridge cover.
Figure 15:
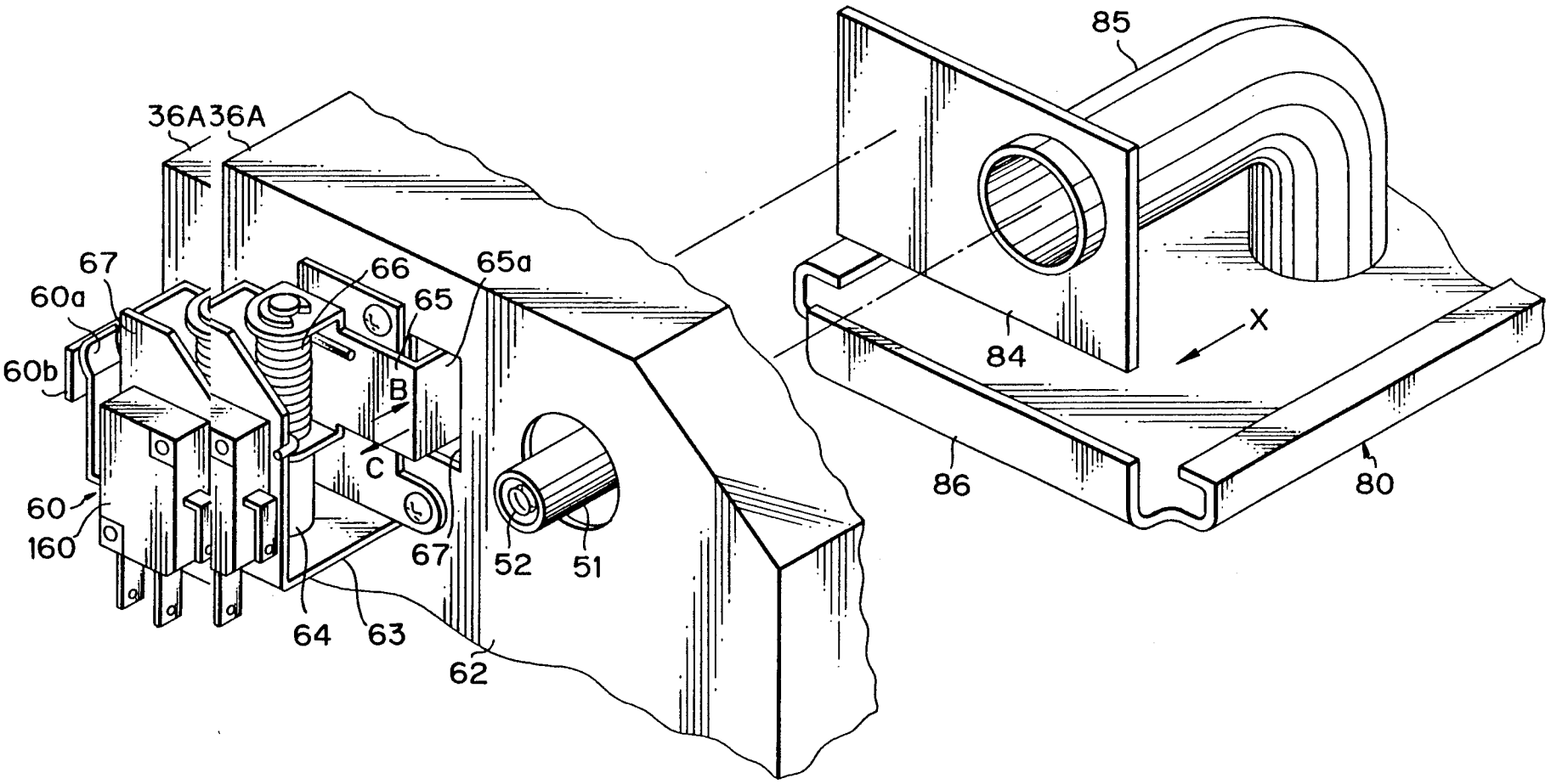
FIG. 15 is a perspective view of the microswitch of FIG. 14 and an arrangement associated therewith.

FIGS. 14 and 15 are perspective views each showing the innermost portion of the cartridge cover 36A which delimites the passageway 28, FIG. 10, of the copier body 100. In these figures, an arrow X indicates the direction in which the cartridge 27 or the restriction member 80 is selectively inserted. As shown, a set sensor 60 is implemented as a microswitch 160 and mounted on the outer surface of the innermost end 62 of the cartridge cover 36A by a bracket 63. A pin 64 is studded on the bracket 63 while a lever 65 is supported by the pin 64 in such a manner as to be rotatable in directions indicated by arrows B and C. One end 65*a* of the lever 65 is received in a hole 67 formed throughout the end 62 of the cartridge cover 46A. The other end 65*b* is capable of abutting against an actuator arm 60*a* extending from the microswitch, or first switch, 160. A torsion coil spring 66 is wound around the pin 64 and has one end anchored to the lever 65 and the other end anchored to the bracket 63. The lever 65, therefore, tends to rotate in the direction B. When the cartridge 27 or the restriction member 80 is not set in the cartridge cover 36A, the end 65*b* of the lever 65 abuts against a stop 67 provided on the bracket 63 due to the action of the spring 66, as shown in FIGS. 14 and 15. In this condition, the other end 65*b* of the lever 65 presses the actuator arm 60*a* of the microswitch 160 to maintain the microswitch 160 in an ON state.

Assume that the cartridge 27 is inserted in the direction X, as shown in FIG. 14, until it reaches the innermost portion of the cartridge cover 36A, as shown in FIG. 10. Then, the innermost end 127*a* of the cartridge body 127 presses the lever 65 against the action of the spring 66. As a result, the lever 65 is rotated in the direction C to move the other end 65*b* thereof away from the actuator arm 60*a* of the microswitch 160. This turns off the microswitch 160 and thereby indicates the presence of the cartridge 27. Likewise, when the restriction member 80 is inserted to the position of FIG. 5 in the direction X, the plate 84 of the member 80 presses the lever 65 to turn off the microswitch 160. This shows the presence of the restriction member 80. The output of the microswitch 160 indicative of the presence of the cartridge 27 or that of the restriction member 80 is sent to the CPU 200 via the I/O 202, as shown in FIG. 6.

On the other hand, as indicated by a dash-and-dot line in FIG. 12, a lever 71 is pivotally mounted on the outer side of the copier body, e.g., the front wall 70, FIG. 10, of the container 36 by a pin 72. A sensor implemented as a microswitch 161 is affixed to the front end 70. A roller 74 is rollably supported by one end of the lever 71 and constantly biased counterclockwise, as viewed in FIG. 12, by a spring, not shown. The output of the microswitch, or second switch, 161 is also sent to the CPU 200, as shown in FIG. 200.

Assume that the cartridge 27 has been set above the container 36, but the shutter 27A has not been pulled yet. In this condition, the cartridge 27 and roller 74 are positioned as shown in FIG. 12 relative to each other. The roller 74 is pressed against the longitudinally extending side 75 of the shutter 27A while the other end of the lever 71 is spaced apart from the actuator arm 176 of the microswitch 161, maintaining the microswitch 161 in an OFF state. A recess 76 is formed in the innermost portion of the side 75 of the shutter 27A and capable of receiving the roller 74 therein.

The cartridge 27 is inserted to the position shown in FIG. 10, and then the shutter 27A is pulled in the direction A. Then, the recess 76 approaches the roller 74 which is rolling on the side 75. When the shutter 27A reaches the outermost or open position, the roller 74 drops in the recess 76. As a result, the lever 71 is rotated counterclockwise, as viewed in FIG. 12, about the pin 72 by the action of the spring. As the other end of the lever 71 presses the actuator arm 176 of the microswitch 161, the microswitch 161 is turned on to indicate that the shutter 27A has been pulled or opened. As shown in FIG. 13, the restriction member 80 is formed with a notch 87 in the outer portion of one side thereof. Hence, when the restriction member 80 is set in the position shown in FIG. 5, the roller 74 is immediately drops in the notch 87. Consequently, the lever 71 is rotated counterclockwise in FIG. 12 about the pin 72 and presses the actuator arm 176 of the microswitch 161 with the other end thereof. The lever 71, therefore, turns on the switch 161, FIG. 15.

Figure 16:
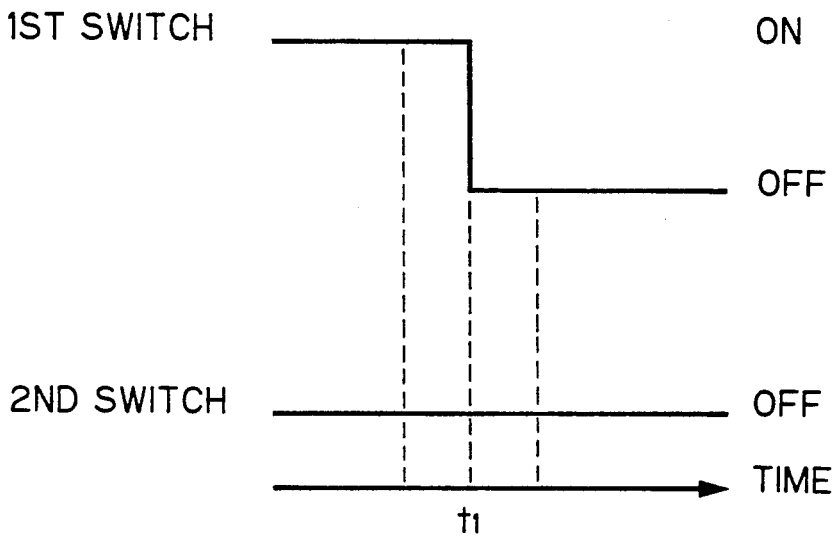
FIG. 16 is a timing chart representative of the operations of the microswitches to occur when the toner cartridge is set in the copier body.
Figure 17:
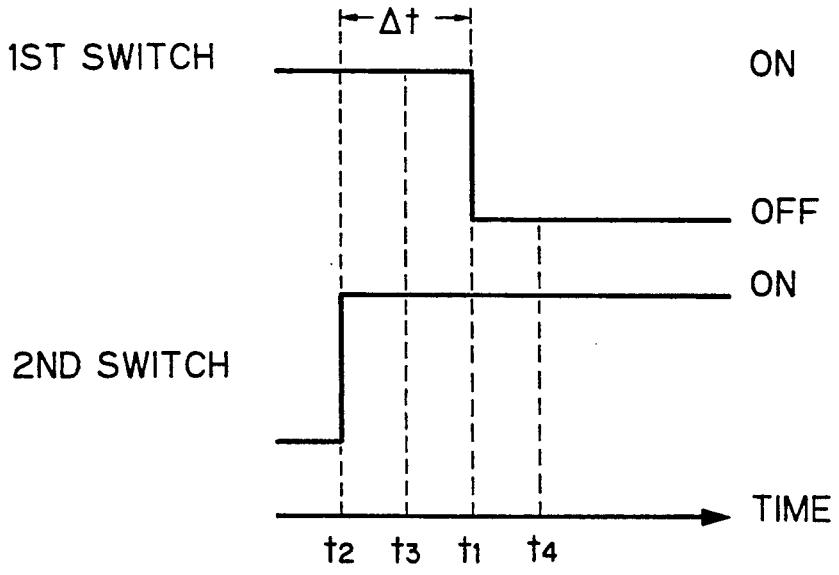
FIG. 17 is a timing chart representative of the operations of the microswitches to occur when the restriction member is set in the copier body.

The above procedure will be summarized with reference to FIGS. 16 and 17. When either of the cartridge 27 and restriction member 80 is set, the first microswitch or first switch 160 turns off at a time $t_1$ when the setting completes, as shown in FIGS. 16 and 17. When the cartridge 27 is set, the roller 74 remains on the side 75 of the cartridge 27 so long as the shutter 27A is not pulled outward. Hence, the microswitch or second switch 161 remains in an OFF state, as shown in FIG. 16. On the other hand, when the restriction member 80 is set, the roller 74 drops in the notch 87 as soon as the setting completes. As a result, the second switch 161 turns on at a time $t_2$ when the roller 74 drops in the notch 87, as shown in FIG. 17. The times $t_1$ and $t_2$ are different from each other by $\Delta t$. This is because the notch 87 extends over a substantial length in the lengthwise direction of the member 80, i.e., the roller 87 drops in the notch 87 to turn on the second switch 161 just before the first switch 160 turns off.

In response to the outputs of the first and second switches 160 and 161, the CPU 200, FIG. 6, determines which of the cartridge 27 and restriction member 80 has been set, as follows. Specifically, when the restriction member 80 is inserted, the CPU 200 sees that the first switch 160 has turned off during the interval between the turn-on of the second switch 161 or a time $T_3$ slightly later than it and a time $T_4$ a predetermined period of time later than it. On the other hand, when the cartridge 27 is inserted, such a decision cannot be done, as FIG. 16 indicates. Instead, the CPU 200 determines which of them has been set on the basis of the difference. The presence of the restriction member 80 is sensed due to the operations of the switches 160 and 161.

By sensing the presence of the restriction member 80, it is possible to constantly indicate on, for example, the operation and display panel 102 that a new toner cartridge 27 should be set on the container 90 and not on the container 36 or to display, when a toner should be supplemented to the container 90 as detected by the previously stated procedure, a message, e.g., "SUPPLEMENT FROM CARTRIDGE TO CONTAINER IN CASING (2nd container)". This will prevent the operator from being confused.

It is to be noted that the first and second switches 160 and 161, roller 74 and recess 76 are used to provide a guidance on the operation and display panel 102 in the event of replacement of the cartridge 27, as described in Japanese Patent Application No. 280528/1988 in detail. The illustrative embodiment uses the switches 160 and 161 and so forth to detect the regulation member 80 when it is mounted. Using the switches 160 and 161 and so forth for multiple purposes cuts down the cost of the entire copier.

It is preferable to provide the casing 53 with the switches 160 and 161 and so forth also, so that the operator may be guided by the operation and display panel 102 in the event of mounting a new cartridge on the container 90.

When the shutter 27A of the cartridge 27 is pulled outward after the turn-off of the first switch 160, the second switch 161 turns on. At this instant, assuming that the second switch 161 turns on a period of time $\Delta T$ later than the turn-off of the first switch 160, the previously mentioned interval $\Delta t$ should, of course, be shorter than $\Delta T$ so as to avoid malfunctions.

The guide pipe 85 of the restriction member 80 promotes smooth transfer of the toner from the tubing 51 to the container 36, as stated earlier. The inner periphery of the guide pipe 85 may be coated with Teflon, Oflon or similar material having high separability to prevent the toner from depositing thereon. This will further enhance the guiding function of the guide pipe 85. When the toner is implemented as a magnetic toner, the guide pipe 85 may advantageously be made of aluminum, resin or similar nonmagnetic material to prevent the toner from magnetically depositing on the inner periphery thereof. Moreover, when the entire restriction member 80 including the guide pipe 85 is constituted by a molding of resin, the production line will be simplified, and the production cost will be reduced. In addition, the single molding is light weight.

If desired, the toner cartridge 27 for supplementing a toner to the container 36 or 90 may be replaced with a toner bottle or similar toner supplementing member.

To minimize the down of the copier ascribable to the fault of the sensors **22*a* and 22*b*, there may be used a plurality of sensors 22*a* and a plurality of sensors 22*b*. Specifically, a group of sensors 22*a* and a group of sensors 22*b*** may each be located at the same level.

As shown in FIG. 5, the agitators 32 and 91 are respectively disposed in the containers 36 and 90 to agitate the associated toners $T_1$ and $T_2$. The container 90 has a great capacity and accommodates a great amount of toner $T_2$ when filled up, exerting a considerable load on the agitator 91. In the light of this, the agitator 91 driven by the motor $M_2$ independent of the motor $M_1$ which drives the agitator 32. Since the motor $M_2$ drives the conveyor member 52 also, it is preferable to use a high output motor and lower the rotation speed in matching relation to the high torque of the agitator 91. At the same time, the gear ratio of the timing pulleys 94 and 95 should preferably be so selected as to increase the rotation speed of the conveyor member 52.

The tubing 51 is made of resin or similar elastic material and can be laid with any desired curvature even when it is long. To prevent the tubing 51 from bending, it may be retained by a holder member 97, FIG. 5, whose base portion is affixed to, for example, the frame 101 of the copier body 100. In this case, if the entire holder member 97 is constituted by a rigid body, the tubing 51 will be firmly retained by the end 97*a* of the member 97. Then, a considerable stress is apt to concentrate on the tubing 51 to cause it to bend, damaging the conveyor member or coil 52. Preferably, therefore, at least part of the holder member 97, e.g., the end 97*a* or the whole member 97 should be made of an elastic member.

The present invention is similarly applicable to image forming apparatuses other than the electronic copier shown and described and even to an image forming apparatus of the type using a single component type developer.

In summary, in accordance with the present invention, a toner can be supplemented from a second toner container to a first toner container before the latter becomes empty. Therefore, even when the toner consumption by a developing device and, therefore, the toner supplement from the first container to the developing device sharply increases, the supplement from the second container to the first container sufficiently follows it. This makes it needless to interrupt an image forming operation even in such a condition. Since the frequency of supplement to the first container increases, it is not needless to increase the amount of toner to be transported by conveying means per unit time. This is successful in preventing the conveying means from being stopped by the toner and in preventing the toner from blocking the first container. As a result, an image forming operation can be continued stably over a long period of time.

As the amount of toner remaining in the first container decreases, the amount of toner supply to the first container sequentially increases. This surely eliminate short and excessive supplement to the first container.

When the second container is used, the operator is inhibited from supplementing a toner to the first container. This prevents an excessive amount of toner from being supplied to the first container. A restriction member prevents the toner in the first container from being scattered around to the outside.

The restriction member itself is provided with a guide pipe for guiding a toner to the first container, eliminating the need for an extra or independent guide pipe. When the second container is used, all that is required is to attach the restriction member to the first container.

The present invention is capable of surely determining which of the restriction member and a toner cartridge has been inserted into the apparatus.

Moreover, even when the second container has a greater capacity than the first container, a second agitator disposed in the second container can be satisfactorily driven and conveying means can transport a toner to the first container.

In addition, a stress is prevented from concentrating on part of a toner transport tubing. The tubing is, therefore, protected from bending while a conveyor member received in the tubing is protected from damage.

Various modifications will become possible for those skilled in the art after receiving the teachings of the present disclosure without departing from the scope thereof.

What is claimed is:

1. An image forming apparatus comprising:

an image carrier for electrostatically forming a latent image thereon;

a developing device for developing the latent image to produce a corresponding toner image;

a first toner container for storing toner to be supplied to said developing device;

a second toner container for storing toner to be supplemented to said first toner container;

conveying means for conveying the toner from said second toner container to said first toner container;

at least one sensor for sensing an amount of the toner remaining in said first toner container; and drive control means for controllably driving said conveying means to supplement the toner from said second toner container to said first toner container when said at least one sensor senses an absence of the toner;

said conveying means including:

a conveyor member, rotated by said drive control means, for the conveying of the toner;

a flexible tube, surrounding said conveyor member, for guiding the toner being conveyed by said conveyor member; and a holder member holding said tube, at least part of said holder member being made of an elastic material.

2. An apparatus as claimed in claim 1, wherein said drive control means comprises a motor.

3. An apparatus as claimed in claim 2, further comprising:

a first agitator for agitating the toner in said first toner container; and a second agitator for agitating the toner in said second toner container;

said second agitator being driven by said motor while said first agitator being driven by another motor.

4. An apparatus according to claim 1, wherein said at least one sensor comprises a plurality of sensors.

5. An apparatus according to claim 4, wherein said drive control means controls a driving speed of said conveyor member using inputs from said plurality of sensors such that as an amount of toner in the first container decreases, the driving speed of said conveyor member increases.

6. An image forming apparatus comprising:

an image carrier for electrostatically forming a latent image thereon;

a developing device for developing the latent image to produce a corresponding toner image;

a first toner container for storing toner to be supplied to said developing device;

a second toner container for storing toner to be supplemented to said first toner container;

conveying means for conveying the toner from said second toner container to said first toner container;

a plurality of sensors each being responsive to a particular amount of the toner remaining in said first toner container; and drive control means for controllably driving said conveying means to supplement the toner from said second toner container to said first toner container when at least one of said plurality of sensors senses absence of the toner, and to sequentially increase a conveying ability of said conveying means as said plurality of sensors sequentially sense the absence of the toner.

7. An apparatus as claimed in claim 6, wherein said drive control means comprises a motor.

8. An apparatus as claimed in claim 7, further comprising:

a first agitator for agitating the toner in said first toner container; and a second agitator for agitating the toner in said second toner container;

said second agitator being driven by said motor while said first agitator being driven by another motor.

9. An apparatus as claimed in claim 6, wherein said conveying means comprises:

a conveyor member rotated by said drive control means;

a flexible tubing for guiding the toner being conveyed by said conveyor member; and a holder member holding said tubing, at least part of said holder member being made of an elastic material.

10. An image forming apparatus comprising:

an image carrier for electrostatically forming a latent image thereon;

a developing device for developing the latent image to produce a corresponding toner image;

a first toner container for storing toner to be supplied to said developing device;

a second toner container for storing toner to be supplemented to said first toner container;

conveying means for conveying the toner from said second toner container to said first toner container;

a plurality of sensors for sensing an amount of the toner remaining in said first toner container; and drive control means for controllably driving said conveying means to supplement the toner from said second toner container to said first toner container when at least one of said plurality of sensors senses an absence of the toner;

said conveying means including:

a conveyor member, rotated by said drive control means, for the conveying of the toner; and a flexible tube, surrounding said conveyor member, for guiding the toner being conveyed by said conveyor member;

wherein said drive control means controls a driving speed of said conveyor member using inputs from said plurality of sensors such that as an amount of toner in the first container decreases, the driving speed of said conveyor member increases.

11. An image forming apparatus comprising:

an image carrier for electrostatically forming a latent image thereon;

a developing device for developing the latent image to produce a corresponding toner image;

a first toner container for storing toner to be supplied to said developing device;

a second toner container for storing toner to be supplemented to said first toner container;

conveying means for conveying the toner from said second toner container to said first toner container;

drive control means for driving said conveying means when the toner should be supplemented from said second toner container to said first toner container; and a restriction member for blocking toner from being supplemented to said first toner container from a source other than said second toner container, when said second toner container is connected to said first toner container using the conveying means.

12. An apparatus as claimed in claim 11, wherein said restriction member comprises a guide pipe for guiding the toner being conveyed by said conveying means to said first toner container.

13. An apparatus as claimed in claim 11, wherein said restriction member comprises detecting means for determining that said restriction member has been mounted on said first toner container.

14. An apparatus as claimed in claim 11, wherein said drive control means comprises a motor.

15. An apparatus as claimed in claim 14, further comprising:

a first agitator for agitating the toner in said first toner container; and a second agitator for agitating the toner in said second toner container;

said second agitator being driven by said motor while said first agitator being driven by another motor.

16. An apparatus as claimed in claim 11, wherein said conveying means comprises:

a conveyor member rotated by said drive control means;

a flexible tube for guiding the toner being conveyed by said conveyor member; and a holder member holding said tub, at least part of said holder member being made of an elastic material.

* * * * *

UNITED STATES PATENT AND TRADEMARK OFFICE

CERTIFICATE OF CORRECTION

PATENT NO. : 5,329,340

DATED : July 12, 1994

INVENTOR(S) : Yutaka FUKUCHI, et al.

It is certified that error appears in the above-indentified patent and that said Letters Patent is hereby corrected as shown below:

On the title page, Item [54] and Column 1, Line 2 the title should read as follows:

--IMAGE FORMING APPARATUS HAVING A SUPPLEMENTAL TONER CONTAINER WHICH CONVEYS TONER TO A FIRST TONER CONTAINER--

Signed and Sealed this

Eleventh Day of October, 1994

*Attest:*

*Attesting Officer*

Bruce Lehman

BRUCE LEHMAN

*Commissioner of Patents and Trademarks*